US006048293A

United States Patent [19]

Lee

[11] Patent Number: 6,048,293

[45] Date of Patent: Apr. 11, 2000

[54] ABDOMINAL EXERCISE APPARATUS

[76] Inventor: Edward Yongjin Lee, 9012 Congressional Ct., Potomac, Md. 20854

[21] Appl. No.: 08/808,035

[22] Filed: Mar. 4, 1997

[51] Int. Cl.[7] ..... A63B 26/00; A63B 21/00

[52] U.S. Cl. ..... 482/140; 482/57

[58] Field of Search ..... 482/140, 145, 482/142, 57, 62, 60, 79, 80, 148, 71–72

[56] References Cited

U.S. PATENT DOCUMENTS

| | | | |
|---|---|---|---|
| 4,402,502 | 9/1983 | Peters . | |
| 4,508,335 | 4/1985 | Kelley et al. | 482/140 |
| 4,564,193 | 1/1986 | Stewart | 482/142 |
| 4,752,067 | 6/1988 | Colonello . | |
| 4,826,150 | 5/1989 | Minoura . | |
| 4,884,804 | 12/1989 | Fenwick | 482/140 |
| 4,974,840 | 12/1990 | Welch | 482/57 |
| 5,120,052 | 6/1992 | Evans . | |
| 5,160,304 | 11/1992 | Van Der Hoeven . | |
| 5,160,305 | 11/1992 | Lin | 482/57 |
| 5,176,603 | 1/1993 | Hundley et al. | 482/140 |
| 5,190,513 | 3/1993 | Habing et al. | 482/140 |
| 5,232,425 | 8/1993 | Miller et al. . | |
| 5,308,306 | 5/1994 | Wang . | |
| 5,368,537 | 11/1994 | Felice . | |
| 5,387,171 | 2/1995 | Casey et al. | 482/142 |
| 5,468,201 | 11/1995 | Minoura . | |
| 5,492,520 | 2/1996 | Brown . | |
| 5,545,114 | 8/1996 | Gvoich . | |
| 5,577,987 | 11/1996 | Brown . | |
| 5,674,168 | 10/1997 | Wilkinson | 482/142 |
| 5,722,917 | 3/1998 | Olschansky et al. | 482/72 |

OTHER PUBLICATIONS

Brungardt, *Kurt, The Complete Book of Abs*, Chapters 2,6,8 and pp. 148–149.

Nordic Track News Release, Copyright 1996, pp. 1–3.

Nordic Track News, Copyright 1996, pp. 1–3.

Forza Advertisement, Copyright 1996, pp. 1–2.

Abflex Advertisement, 1 page.

Absculptor Advertisement, 1 page.

Korean Advertisement for Exercise Apparatus No. 1.

Korean Advertisement for Exercise Apparatus, No. 2.

Article #1, "Ab Machines Make Retail Sit Up and Take Notice" Discount Store News, Jun. 17, 1996, pp. 1–3.

Article #2, "Battle Shapes Up Between NordicTrack and Rival", Minneapolis–St. Paul City Business, Aug. 23, 1996, pp. 1–2.

Article #3, "Battle of the Bulge–Busters", Sales & Marketing Management, Oct. 1996, p. 1.

Article #4, "All Those AB Machines Really Work", The Dayton Daily News, Sep. 24, 1996, pp. 1–2.

Article #5, "Getting to the Gut of Looking Ab–Solutely Fit", Sacramento Bee, May 27, 1996, pp. 1–2.

Article #6, "ABS–olutely fabulous The craving for chiseled stomach muscles America's fascination with the washboard look", USA Today, May 21, 1996, pp. 1–4.

*Primary Examiner*—Stephen R. Crow

*Attorney, Agent, or Firm*—H. Jay Spiegel

[57] ABSTRACT

An exercising apparatus having a frame located forwardly of a supporting surface on which a person may assume a seated position with knees in a first position elevated above the supporting surface and feet in a second position lower than the first position. A leg stabilizer is supported by the frame to maintain the knees in the first position, and a pair of crank handles are supported by the frame for rotation about a common crank axis located near the first position. The pair of crank handles are located on opposite sides of the knees of the person to be movable by hands of the person through complete revolutions. The leg stabilizer may include a knee stabilizer in the first position and a foot stabilizer in the second position to ensure that the person's legs are bent at the knees though an angle approximating 90°.

54 Claims, 13 Drawing Sheets

ABDOMINAL EXERCISE APPARATUS

BACKGROUND OF THE INVENTION

The present invention relates an to exercising apparatus, and, more particularly, to such apparatus intended primarily, though not exclusively, for exercising the abdominal muscles of person.

The abdominal area of the human body is comprised of four muscle groups including the rectus abdominis, the external obliques, the internal obliques and the transverse abdominis.

The rectus abdominis muscles are a pair of long flat muscles located on either side of the navel which run the length of the abdominal area, from the pubic bone to the chest. The rectus abdominis originates in the crest of the pubis and inserts at the cartilage of the fifth, sixth, and seventh ribs, and the sternum. They are interconnected by the linea alba, a band of fibrous connective tissue. The rectus abdominis pulls the torso toward the hips and is responsible for tilting the pelvis which effects the curvature of the lower back.

The external obliques are broad, thin, flat muscles situated on the lateral and anterior parts of the abdomen and attached by fibrous connective tissue to the abdominis rectus. They originate from the lower eight ribs and attach with the serratus muscle that covers the ribs. The external obliques aid in the twisting of the trunk. Specifically, the left external oblique is used when twisting to the right, and the right external oblique is used when twisting to the left.

The internal obliques are thin, small muscles which lie underneath the external obliques and run in a diagonally opposite direction. They extend from the lateral margins of the lower rib cage and are directed inwardly toward the rim of the pelvic iliac bone. The internal obliques are also attached to the abdominis rectus muscles by fibrous connective tissue. The internal oblique muscles aid the trunk in twisting in the same direction as the side they are on. Specifically, the left internal oblique aids the right external oblique to twist the torso to the left, while the right internal oblique aids the left external oblique to twist the torso to the right.

The transverse abdominis is a broad, very thin muscle which runs horizontally across the abdominal wall and along the midsection underneath the external and internal obliques. The transverse abdominis originates from the rim of the crest of the ilium, the lower six ribs, running along the outer part of the inguinal ligament, and connects to the lumbar muscle. It pulls the abdominal wall inward, forcing expiration.

Because these four muscles are located in the center of the body, the process of isolating and developing them has proven to be a difficult and often rigorous task.

One popular exercise for the abdominal muscles is known as the "sit-up." During such an exercise, a person lying in a supine position with knees flexed into an upward position and hands behind the neck, slowly curls and uncurls the upper body so as to bring the head toward the stationary knees. Typically, the purpose of these types of abdominal flexion exercises is to require the upper torso to flex in a curling and uncurling manner so as to bring about a strengthening of the muscles of the abdomen, particularly the rectus abdominis.

Variations of the sit-up exercise include starting from a fully flexed position and lowering to an intermediate position which is held before returning to the upright position.

Another variation, called a "sit-up twist," entails a twisting motion at the end of the upward movement such that one elbow touches the opposite knee. A twisting motion at the end of the curl, such as in a sit-up twist, serves to exercise the external obliques in addition to the rectus abdominis.

Occasionally, the sit-up is performed with the aid of a partner commonly referred to as a "spotter." The role of the spotter is to hold down the feet of the exerciser so as to restrict movement of the legs during the sit-up. Alternatively, a "sit-up board" may be used. The sit-up board includes an inclined, cushioned surface that functions as a seat, and some type of anchor, such as a strap or padded bar, under which the ankles are secured. A separate knee support for supporting the backs of the knees also is found in many sit-up boards. The only way to adjust the resistance while performing a traditional sit-up regardless of whether performed alone, with a spotter, or on a sit-up board, is for the user to grasp a weight plate or other heavy substance across his chest to increase the effort required to raise the upper torso to the upright position.

Another prevalent, but somewhat more strenuous exercise for the abdominal muscles is referred to as the "leg lift." The most basic type of leg lift entails a person lying supine to extend and raise both legs upward to approximately 90 degrees and then to lower them to their original position. Variations on the leg lift include bending at the knees, alternating leg lifts, raising the legs to different heights and in different directions, and simulating a bicycle pedaling motion in the air. Typically, leg lift exercises develop the transverse abdominis and lower rectus abdominis muscles as portions of the lower body are raised and lowered while the upper body remains stationary.

In recent years, the growth of the field of sports medicine has brought with it much criticism of the sit-up and other conventional abdominal exercises. The first wave of criticism revolved around the positioning of the hands and arms while performing the sit-up. These critics claimed that positioning the hands clasped behind the neck put undue stress on the neck and spine when doing a sit-up. Therefore, to avoid injury to the neck and spine, several alternatives were recommended, including positioning the hands on ears, hands on top of head, hands folded across chest, and hands extended forward. Significantly, a consensus evolved that performing a sit-up with the hands and arms extended fully forward is the position of least resistance and least stress upon the neck.

The second attack on the sit-up relied on the theory that the flexion of the lumbar and thoracic spine over a significant range of motion might cause strain on the lower back. Accordingly, some in the medical field advocated limiting the range of motion of the spine during abdominal exercises to prevent injury to the lower back and spine. The result of their efforts was a widespread adoption and use of a variation on the sit-up referred to as a "crunch."

A "crunch" is performed when a person lying on his back with knees bent and hands folded behind his head raises only his shoulder blades off the floor in a forward-curling motion and then lowers his shoulders to the starting position. During the forward-curling motion, the small of the back remains in contact with the floor resulting in an exercise with a very limited range of motion. This exercise succeeds in isolating and developing the upper rectus abdominis, but leaves the remaining muscles of the abdomen unaffected.

In response to the criticism against the traditional sit-up exercise, many new machines were developed beginning in the early 1990's touting less strenuous means of exercising the abdominal muscles. The most popular of these machines suffer three major drawbacks, that is, 1) they are not cardiovascular fitness devices and will not "spot reduce" fat; 2) they have no or very limited resistance control mechanisms; and 3) they activate only a very small portion of the four muscle groups of the abdomen.

In response to these type of machines, many in the sports health industry have returned to advocating traditional abdominal exercises capable of being performed on a simple exercise mat laid on the floor.

SUMMARY OF THE INVENTION

The advantages and purpose of the invention will be set forth in part in the description which follows, and in part will be obvious from the description, or may be learned by practice of the invention. The advantages and purpose of the invention will be realized and attained by means of the elements and combinations particularly pointed out in the appended claims.

To attain the advantages and in accordance with the purpose of the invention, as embodied and broadly described herein, the exercising apparatus of the invention comprises a frame located forwardly of a supporting surface on which a person may assume a seated position with knees in a first position elevated above the supporting surface and feet in a second position lower than the first position. A leg stabilizer is supported by the frame to maintain the knees in the first position, and a pair of crank handles are supported by the frame for rotation about a common crank axis located near the first position. The pair of crank handles are located on opposite sides of the knees of the person to be movable by hands of the person through complete revolutions.

Preferably, the leg stabilizer includes a knee stabilizer in the first position and a foot stabilizer in the second position to ensure that the person's legs are bent at the knees at an angle approximating 90°. However, the leg stabilizer may be provided as a single restraint positioned above the knees of a person seated on the supporting surface with that person's feet positioned on the supporting surface.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention. In the drawings.

DESCRIPTION OF THE PREFERRED EMBODIMENTS

Reference will now be made in detail to the present exemplary embodiments of the invention, examples of which are illustrated in the accompanying drawings. Wherever possible, the same reference numbers will be used throughout the drawings to refer to the same or like parts.

In accordance with the present invention, an exercising apparatus accommodates a user in a seated position on a supporting surface with knees in a first position elevated above the supporting surface and feet in a second position lower than the first position. A leg stabilizer is provided to maintain the knees in the first position, and a pair of crank handles are supported for revolution about a common crank axis located near to the first position. The pair of crank handles are located on opposite sides of the knees of the user to be movable by the user's hands through complete revolutions.

Figure 1:
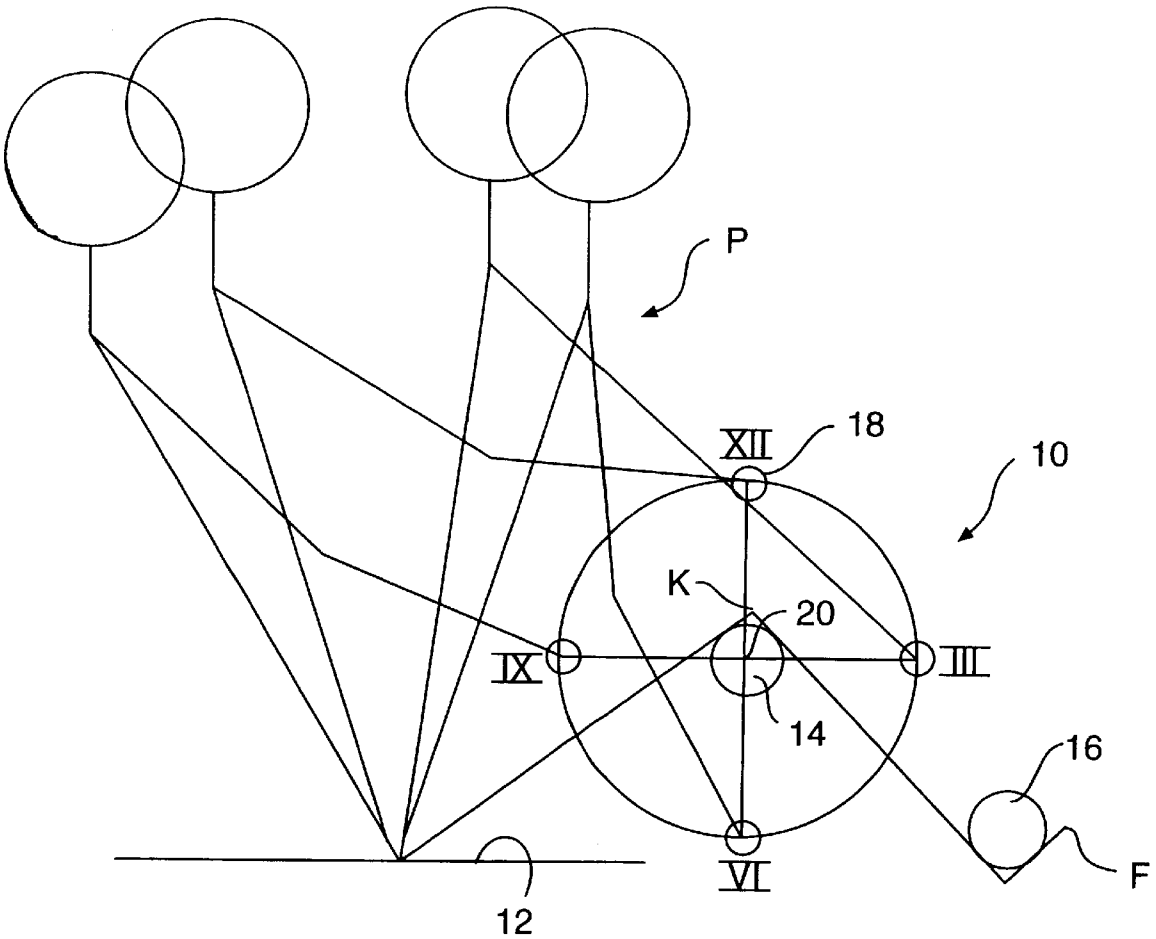
FIG. 1 is a schematic diagram depicting principal components of the apparatus of the invention in relation to a person using the apparatus.

In FIG. 1 of the drawings, the preferred embodiments of the invention are conceptualized schematically by lines representing an exercising apparatus 10, a supporting surface 12 on which a user P may be seated with the user's knees K elevated above the supporting surface by a knee stabilizer or support 14 and the user's feet F restrained against upward movement by a foot stabilizer 16. A pair of cranks 18 are revolvable on a common axis 20 positioned near, preferably concentric with, the knee stabilizer 14. As will be explained in more detail in descriptions of physical embodiments to follow, the cranks may be equipped with devices to variably resist rotation by the hands of the user to effect the abdominal exercising movement depicted by the multiple position of the user P shown in FIG. 1.

Figure 2:
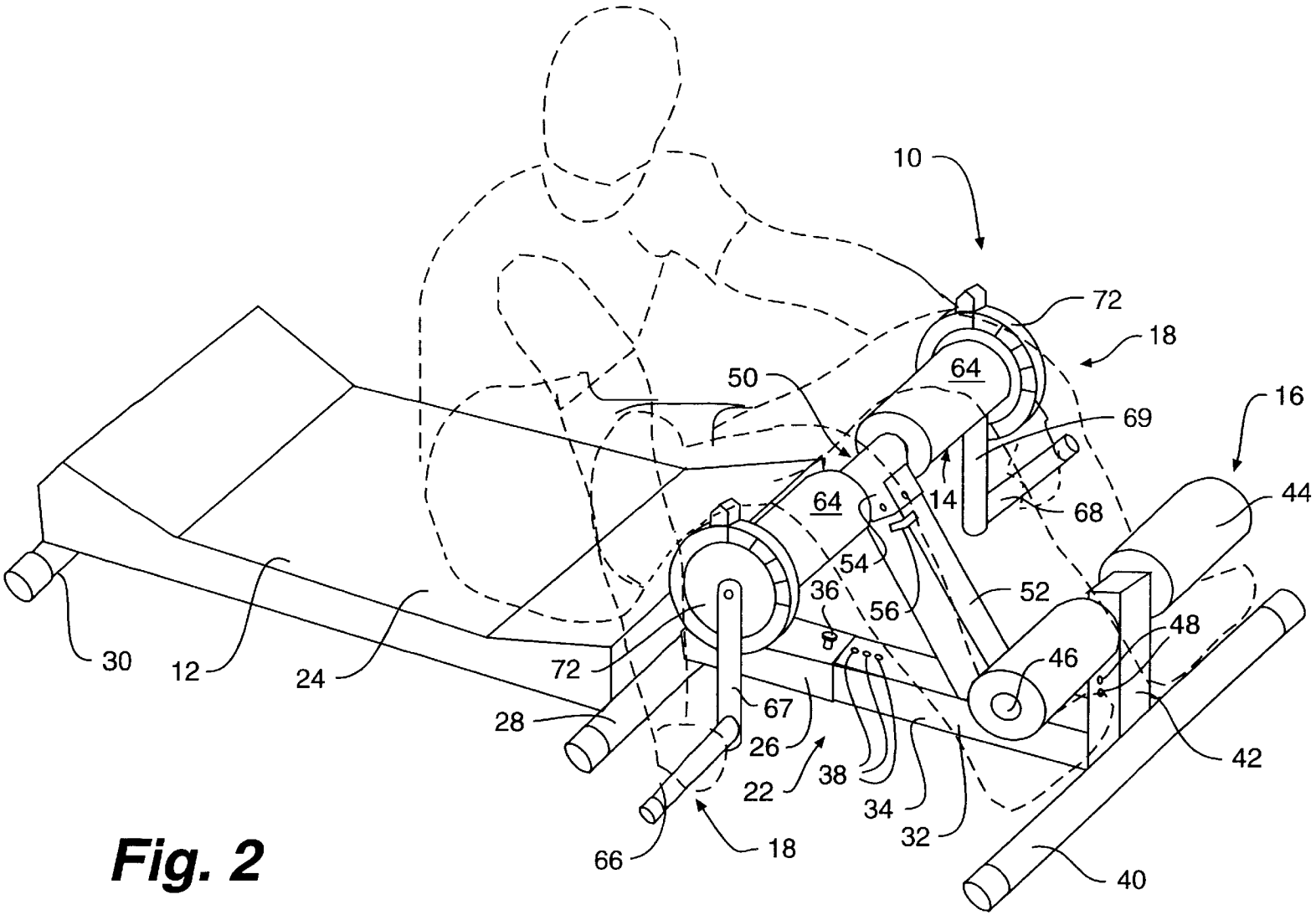
FIG. 2 is a perspective view illustrating a presently preferred embodiment of the invention.
Figure 3:
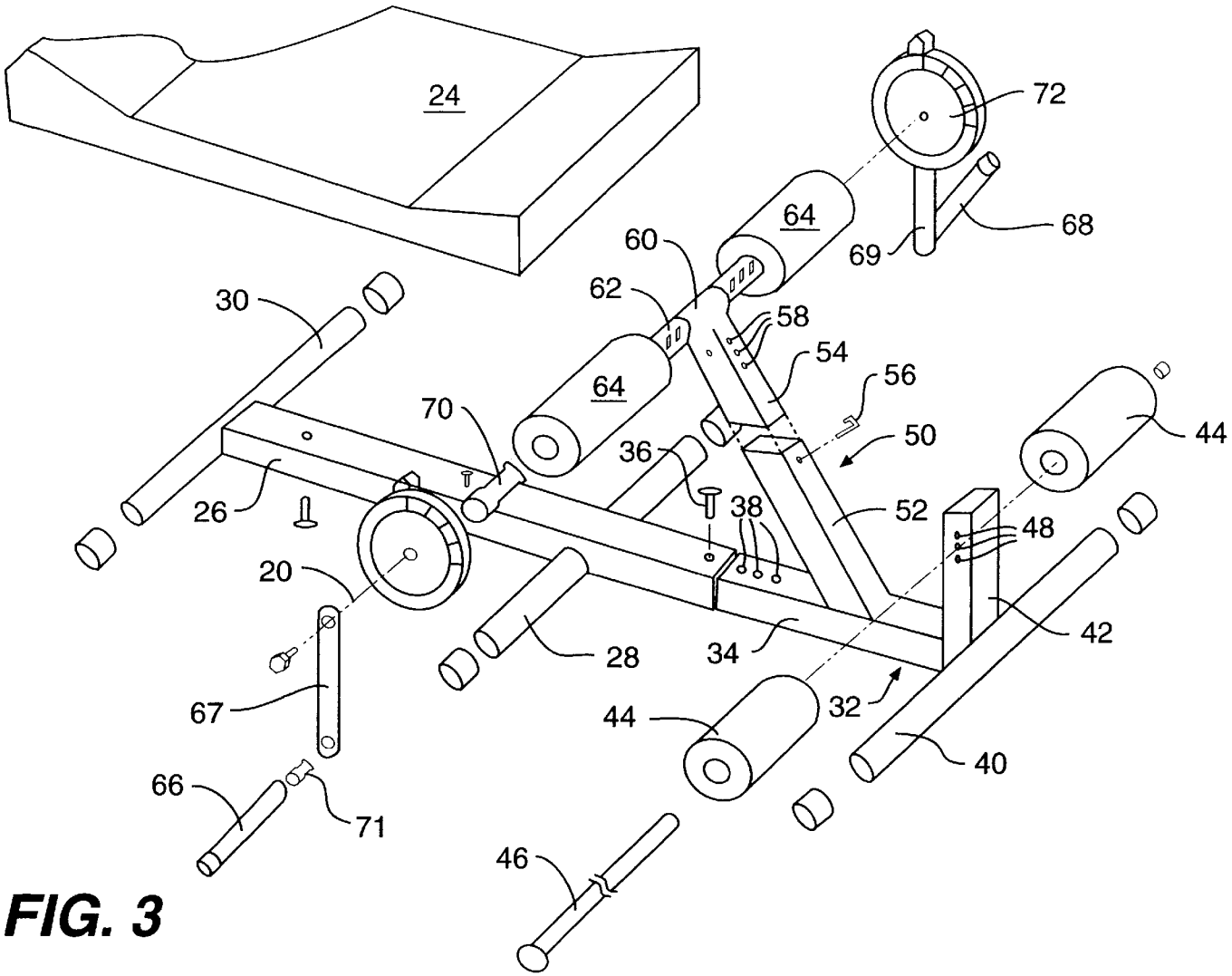
FIG. 3 is an exploded perspective view showing parts of the embodiment of FIG. 2.

In FIGS. 2 and 3 of the drawings, a preferred embodiment of the apparatus 10 is shown to include a frame 22 supporting and extending forwardly of a contoured pad 24 defining the supporting surface 12. The frame 22 includes a central beam member 26 to which laterally extending struts 28 and 30 are welded or otherwise secured for supporting the pad 24 and for stabilizing the apparatus 10 in an upright position on a floor, for example. A front section 32 of the frame 22 extends forwardly of the pad 24 and is connected to the front end of the beam 26 by a telescopic tubular member 34 for adjustable fore and aft positioning by a pin 36 receivable through spaced holes 38 in the tubular member 34. A lateral strut 40, welded or otherwise secured to the front end of the tubular member 34, stabilizes the front section 32 of the frame 22 on the floor supporting the apparatus.

A vertical front standard 42 is secured to the front end of the tubular member 34 to support the foot stabilizer 16 which, in this embodiment of the invention, includes a pair of cylindrical sponge pads 44 supported on opposite sides of the front standard 42 by an axle 46. Height of the foot stabilizer 16 may be adjusted by inserting the axle 46 in any one of several vertically spaced holes 48 in the front standard 42.

An inclined rear standard 50 is secured to the tubular member 34 rearwardly of the front standard 42 to support the knee stabilizer 14 at adjustable elevations above the seating surface 12. The rear standard 50 includes a lower tubular section 52, welded or otherwise secured to the tubular member 34 of the front frame section 32, and an upper section 54 telescopically receive in the tubular section 52 to be fixed in one of several positions by a pin 56 engaged with one of multiple holes 58 in the upper section 54.

In a boss 60 at the upper end of the upper section 54 of the rear standard 50, a transverse tube 62 comprising a generally horizontal member projects laterally in opposite directions. In the illustrated embodiment, the tube 62 is fixed such as by welding or by other rotation resisting means, against rotation in the boss 60. The knee stabilizer 14 in this embodiment is defined by cylindrical sponge pads 64 supported on the exterior of the tube 62 on opposite sides of the upper standard section 54.

The cranks 18 include a pair of crank handles 66 and 68 supported respectively at the ends of crank arms 67 and 69 by bearings 71. The crank arms 67 and 69, in turn, are supported for rotation on the common axis 20 at the outer ends of the tube 62 by bearings 70. Associated with each crank arm 67 and 69 is an adjustable torque loading device 72, preferably a magnetic torque resisting device of the type disclosed in U.S. Pat. No. 5,468,201, the complete disclosure of which is incorporated by reference. In particular, revolution of the crank handles results in rotation of a disk (not shown) located between fixed magnetic means (not shown) within the housings of the illustrated devices 72 to vary the resistance to revolution of the crank handles 66 and 68.

To use the apparatus, a user first sits on the pad 24 facing in the direction of the front standard 42. The user then adjust the height of the knee stabilizer 14 and the common axis 20 of the crank arms 67 and 69, and the distance between the foot stabilizer 16 and the pad 24 such that his/her knees are bent at a 90 degree angle and both feet are secured by the foot stabilizer 16 as exemplified in FIGS. 1 and 2.

The height of the knee stabilizer 14 and crank arm axis 20 is adjusted by first removing the selector pin 56 from the inclined rear standard 50, sliding the upper section 54 up or down until the knee stabilizer 14 is directly below the knees and so that the surface of the lower knees is in direct contact with the sponge pads 64, and reinserting the selector pin 56 through the appropriate hole 58. The distance between the pad 24 and the foot stabilizer 16 may be similarly adjusted using the pin 36. The foot stabilizer 16 is adjusted by inserting the axle 46 in a selected one of the vertically spaced holes 48. Having correctly adjusted the front and rear standards 42 and 50 in this manner, the user's knees should be bent at approximately a 90 degree angle and his legs secured tightly at the knees, ankles, and feet.

At this point, the user may, if desired, perform a traditional sit-up exercise. However, the preferred use of the apparatus 10 entails that the user grasp the handles 66 and 68 connected to the crank arms 67 and 69, after having secured his/her legs with the above mentioned stabilizers. Holding on to the crank handles 66 and 68 with palms faced downward, the user then holds his/her arms and hands in a state so that they revolve in unison with both crank arms extending in the same radial plane through the axis 20. As the upper torso moves up and down in performing the sit-up, the crank arms turn in a rotary motion forwardly, or in a clockwise direction as shown in FIG. 1.

The resistance level of this exercise motion can then be adjusted in two ways. The first method is to bend the arms slightly so that the magnitude of the movement of the upper torso is reduced. This results in a shorter range of motion of the exercise and significantly reduces the effort required for each repetition since the complete movement occurs from a more upright position. The second method is through the use of the resistance devices 72 to adjust the torque of the cranks. When set on "low", the crank turns freely with very little resistance. As the setting is moved toward "high", the crank becomes progressively more difficult to turn. In order to overcome the increased torque resistance, the abdominal muscles must expend more effort to turn the crank handles.

At the point in the revolution of the crank where the upper torso comes closest to the ground, the crank is positioned such that the user may slightly use his/her hands and arms, if needed, to assist the abdominal muscles in raising the upper torso to an upright position. Graphically, this point is reached when the crank arms are located at position IX in FIG. 1. Significantly, the positioning and angle of the inclination of the upper torso while the crank arms are at position IX are at the exact state at which the most difficult portion of the sit-up exercise commences. For it is at this stage that the reclined upper torso must now be raised to an upright position by using the abdominal muscles. At this stage, the crank handles of the present invention, being situated at position IX, are restricted against any further movement towards the user by the set crank arm length, such that the user may grasp and pull on the crank handles with his hands and arms to assist the abdominal muscles in bringing the upper torso to an upright position. This point in the circular path of the crank arm is an important feature of the invention because it allows the hands to displace some of the stress and difficulty of performing conventional, abdominal exercises. One particularly effective means of applying this principle would be for the user to grasp the crank handles in position IX with palms facing upward and perform crunches, curling the body upward either with or without raising the shoulder blades off the pad.

Alternatively, the user may choose to turn the cranks backwardly, or in a counter-clockwise direction as shown in FIG. 1. While the movement of the upper torso remains mostly unchanged, the participation of the hands and arms and direction of the movement makes this an identifiably different exercise than using forward crank turns. While the forward crank turns are reflective of bicycle pedaling, backward crank turns are more akin to the motions of rowing a boat.

Another alternative is to alternate the turning of the cranks in a pedaling style of movement. This, too, can be performed with the cranks turning either forwardly or backwardly.

Yet another alternative is to use the crank handles to guide the upper torso in performing sit-up twists. This can be performed with the crank handles held above the knees in which case the crank arms will travel above positions III and IX of FIG. 1, or with the crank handles held below the knees where the crank arms would move back and forth below positions III and IX. Using the crank handles as a guide, each twisting motion of the body becomes more controlled, more homogeneous, and more rhythmic. The use of the torque resistance device 72 to adjust the difficulty level is especially useful in this exercise because it provides a means of intensifying the relatively easy motion of turning the upper body left and right.

Figure 3A:
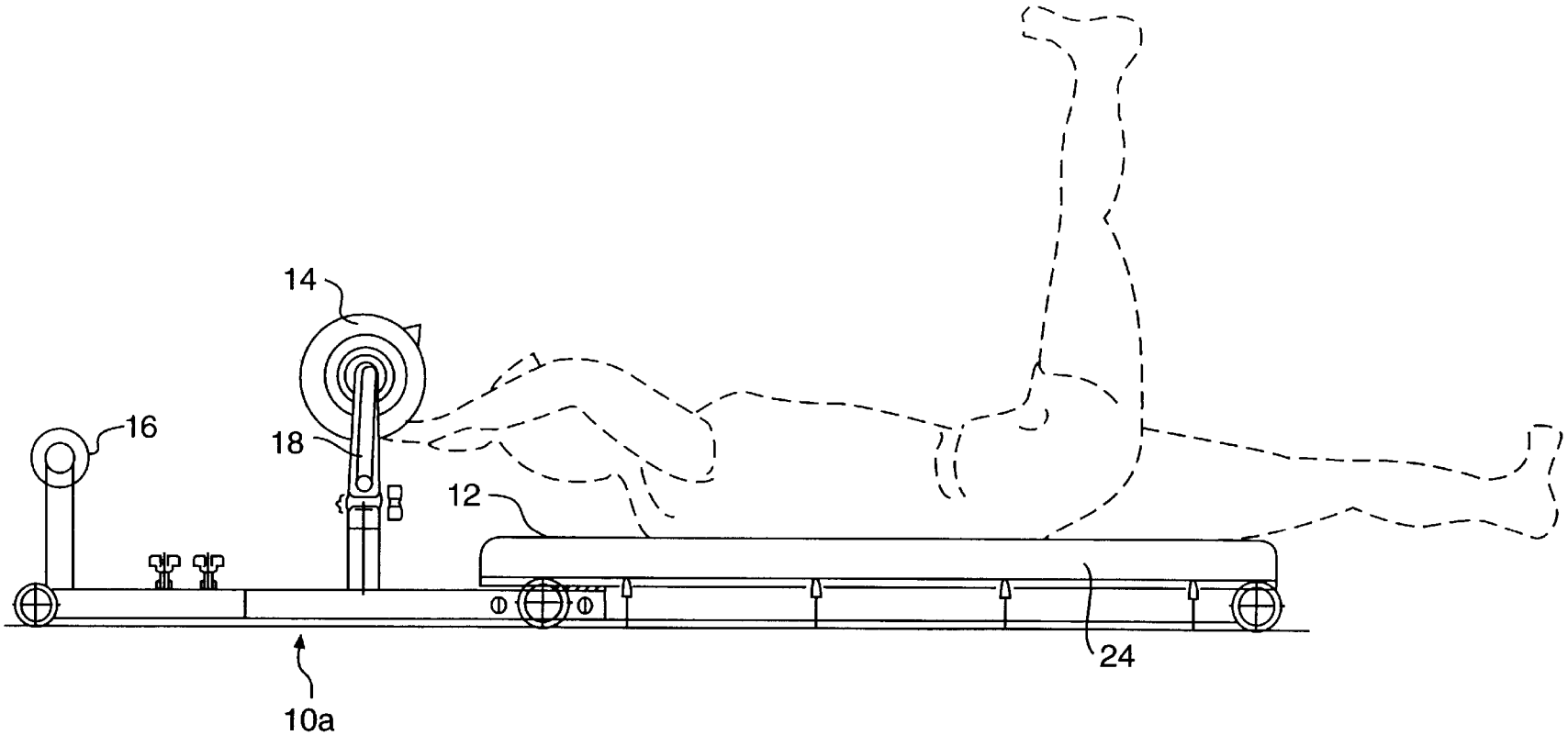
FIG. 3A is a side elevation depicting a modified use of the present invention.

In the event that the user wishes to perform exercises such as leg lifts and the like, rather than exercises of the sit-up variety or crank-assisted variety, he/she may adjust the apparatus and his/her positioning on the bed accordingly. To perform leg-lifts and the like, the user must reverse his/her positioning on the pad 24 such that his/her head faces toward the forward structure and lie supine on the bed. This position is shown in FIG. 3A with a modified apparatus 10*a* to be described in more detail below. Before doing this, however, and with reference to FIGS. 2 and 3, he/she must first lengthen the distance between the pad and the front frame section 32. This is accomplished by removing the selector pin 36 from the beam member 26, sliding the front frame section 32 forwardly, then replacing the selector pin 36 through one of the holes 38 in the tubular member 34. In selecting the appropriate distance, the user should ensure that there is sufficient clearance between his/her head and the knee stabilizer 14.

Once the apparatus has been adjusted accordingly and the user positioned with his/her legs protruding over the pad 24, the user may grasp the knee stabilizer with his/her hands so as to anchor his/her upper body while raising his/her legs up and down Alternatively, from this position, the user may perform a variety of abdominal exercises designed to be performed while laying supine on a cushioned surface stationed on the floor, commonly referred to as an "exercise mat." These include all varieties of leg raises, crunches and sit-ups, as well as numerous other exercises designed to develop the muscles of the abdomen, legs, and hips.

Thus, the apparatus of the invention is a multi-functional abdominal exercise device. First, it is a fully functional sit-up board wherein the user's legs are held fast such that a conventional sit-up may be performed. Second, it is a device upon which an unconventional "crank-assisted sit-up" may be performed in which the user's arms are continuously extended forward throughout the exercise and the workload of the abdominal muscles is determined by the extent to which the user's arms are bent or straightened and the condition of the friction resistance devices. Finally, it is an exercise mat with a structure to anchor the upper body while the user performs abdominal exercises such as leg raises.

In the ensuing descriptions of alternative embodiments of the invention, parts identical to parts previously identified are designated by the same reference characters, parts corresponding to but differing in structure from previously identified parts are designated by the same reference numeral with a letter suffix, and new parts designated by new reference characters.

Figure 4:
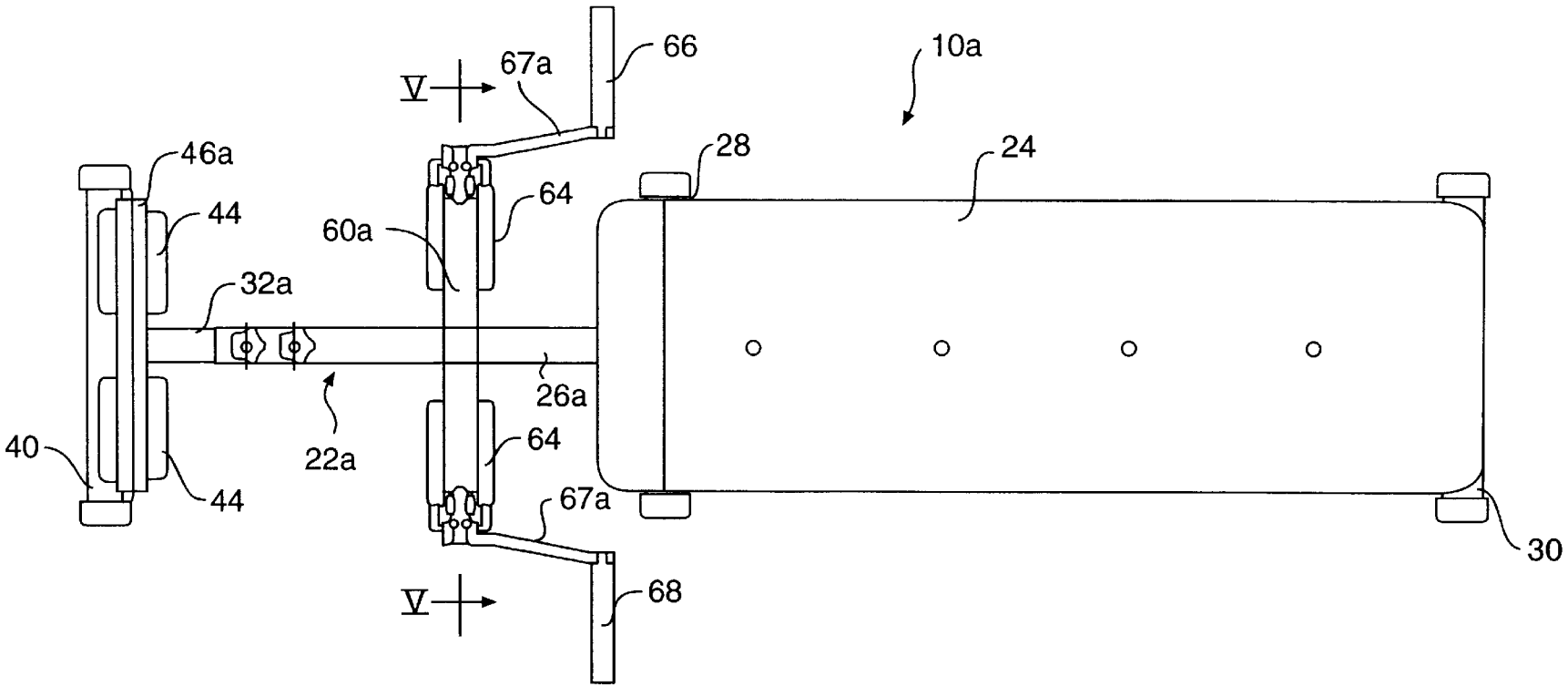
FIG. 4 is a plan view of an alternative embodiment of the invention.
Figure 5:
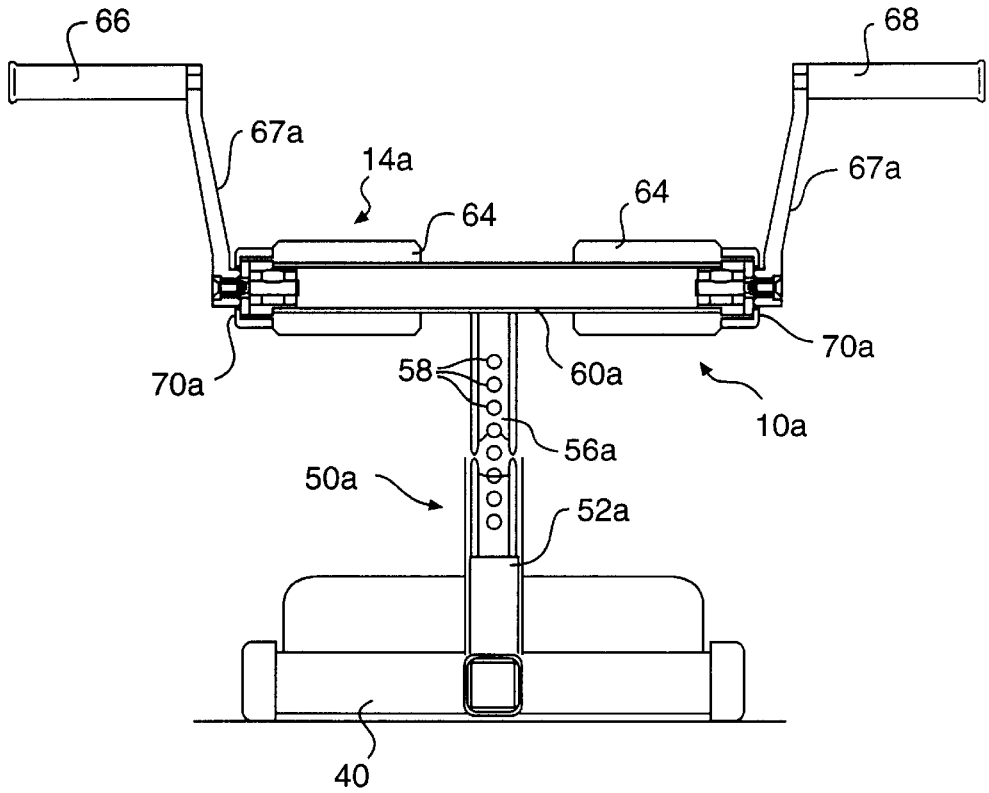
FIG. 5 is a cross section on line 5—5 of FIG. 4.
Figure 6:
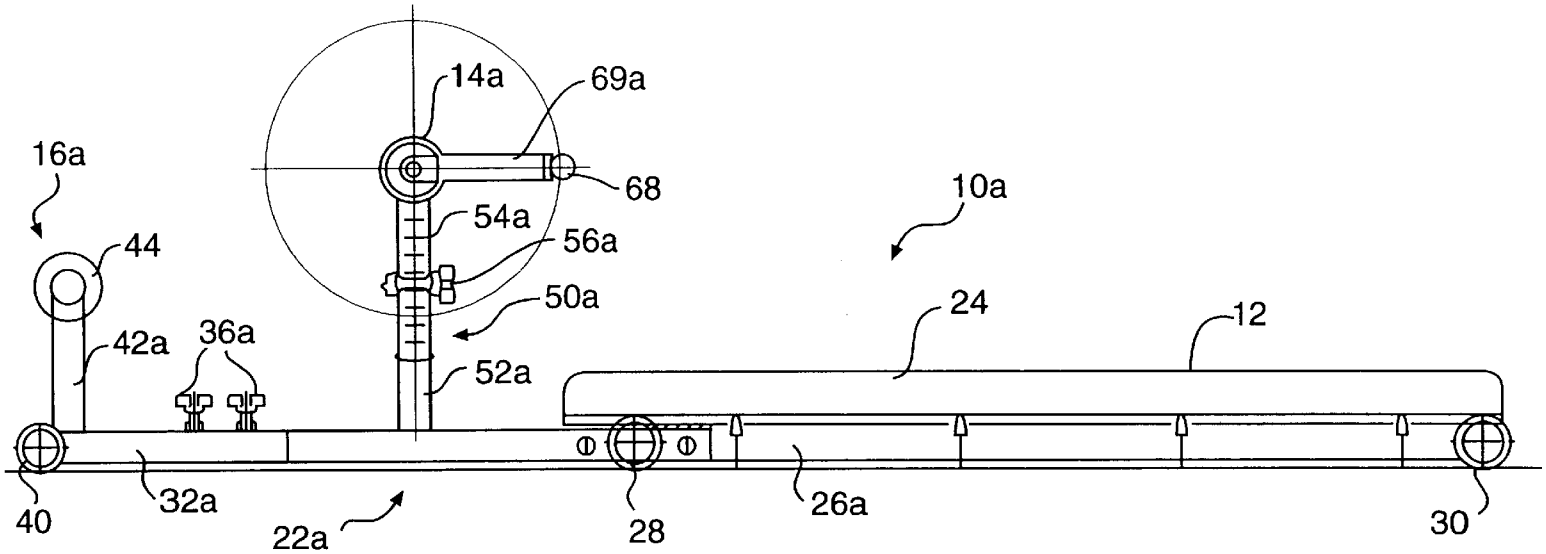
FIG. 6 is a side elevation of the embodiment illustrated in FIG. 4.

Thus, in FIGS. 4–6, an alternative embodiment of an exercising apparatus 10*a* is shown to include a frame 22*a* which differs from the previous embodiment in that the foot stabilizer 14*a* is supported at a fixed elevation by a one piece front standard 42*a*. Also, only the foot stabilizer is supported by the fore and aft adjustable front frame section 32*a*. The rear standard 50 is secured to a forwardly extending portion of the beam member 26*a* in a vertical orientation and includes lower and upper telescopic sections 52*a* and 54*a* secured at a selected length by a bolt 56*a*.

As shown in FIG. 5, the upper section 54*a* of the rear standard 50 is T-shaped to include a cross tube 60*a* which supports the sponge pads 64 of the knee stabilizer 14*a*. Also the crank arms 67*a* and 69*a* are supported at opposite ends of the tube by bearings 70*a* for rotation on the axis 20.

Figure 7:
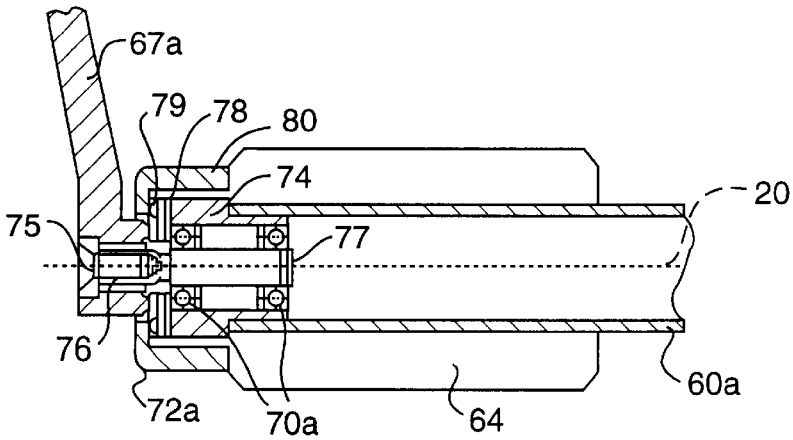
FIG. 7 is an enlarged fragmentary cross section illustrating a variable friction drag for the embodiment of FIG. 4.

As shown most clearly in FIG. 7, the bearings 70*a* are supported inside of the cross tube 60*a* by a bushing 74 secured against rotation in the cross tube 60*a*. The crank arms 67*a* and 69*a* are each secured by an axial screw 75 through splines 76 on the outer end of a stub axle 77 rotatably supported by the bearings 70*a*.

A friction-type adjustable torque loading device 72*a* is associated with each crank arm 67*a*, 69*a* and the stub axles 77. The device 72*a* includes a rotatable disc 78 keyed or otherwise fixed to the stub axle 77, a friction pad 79 and a cap 80 threaded to the bushing 74 so as to draw the friction pad against the rotatable disc 78 and the outer end face of the bushing 74. By rotatably adjusting the cap 80, a variable friction drag is imposed against rotation of the crank arms 67*a* and 69*a* about the axis 20 in a manner similar to the magnetic torque resisting devices 70 in the embodiment of FIGS. 2 and 3.

Figure 8:
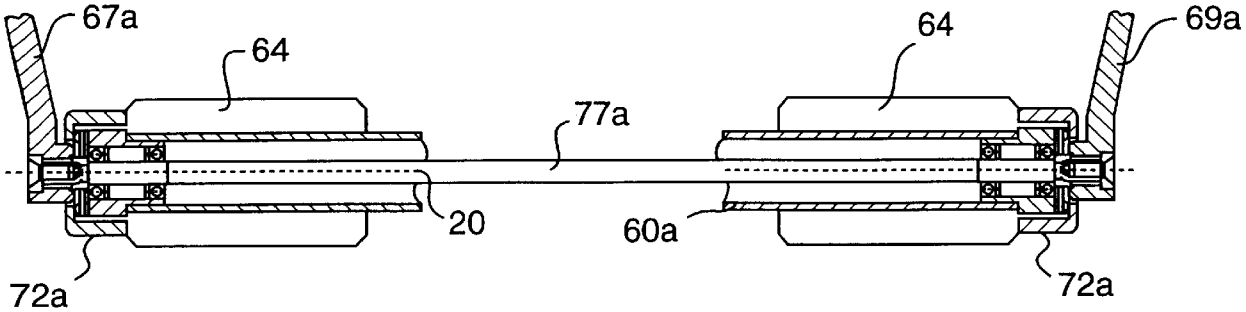
FIG. 8 is a fragmentary cross section illustrating a modification of the crank assembly shown in FIGS. 4, 5 and 7.

To accommodate a wide variation of sit-up type exercises using the apparatus of the invention, it is preferred that the crank arms are independently rotatable about the axis 20 as they are in both embodiments so far described. On the other hand, execution of the sit-up exercising movement depicted in FIG. 1, for example, by a less coordinated person or a beginning user of the apparatus, for example, may be facilitated by fixing the positions of the crank arms so that both lie in the same plane radiating from the crank axis 20. FIG. 8 shows a variation of the embodiment of FIGS. 4–6 in which the crank arms 67*a* and 69*a* are connected so they cannot rotate independently of each other.

As shown in FIG. 8, the stub axles 77 are replaced by a single shaft or axle 77*a* to which both crank arms 67*a* and 69*a* are fixed at opposite ends in the same manner described with respect to the stub axles. The result of this variation is that although both cranks may be moved in either a clockwise or a counter-clockwise direction, they must be moved in unison.

Figure 9:
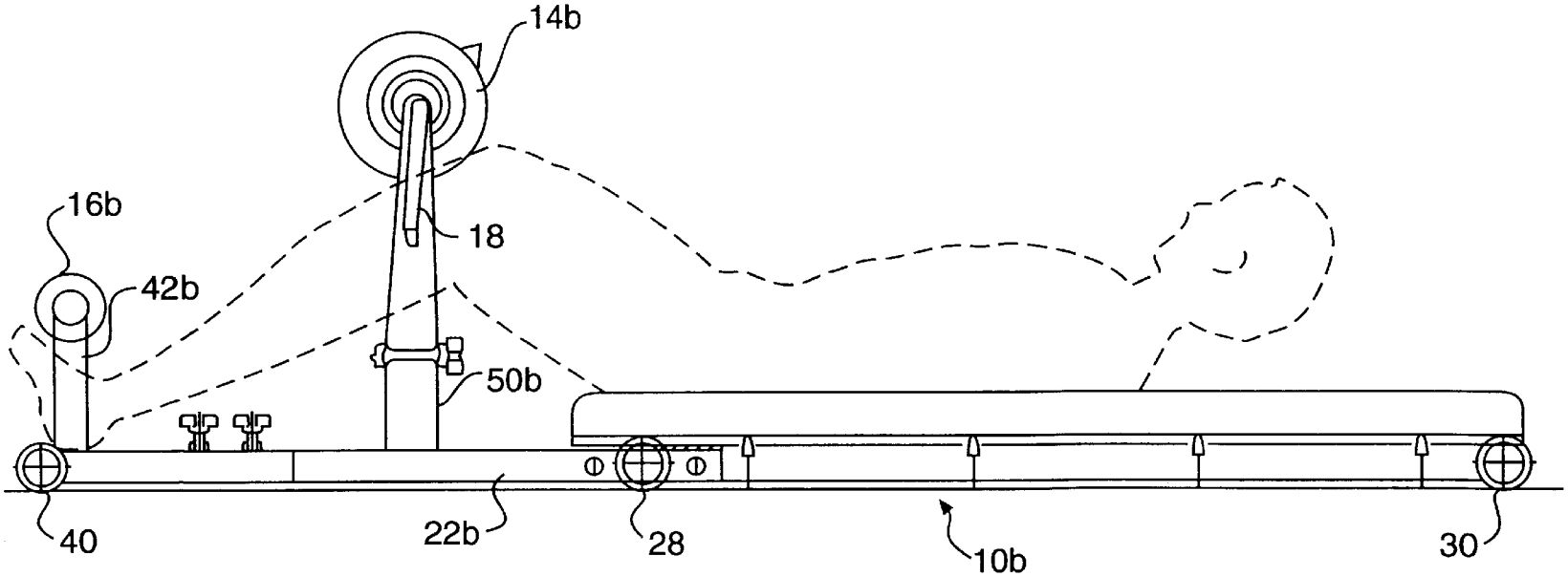
FIG. 9 is a side elevation illustrating another alternative embodiment of the invention.

In FIG. 9 of the drawings, a further alternative embodiment of the invention is illustrated, and which includes a modified frame 22*b* supporting the pad 24 essentially as described above. In this embodiment, the knee stabilizer 14*b* is supported by the rear standard 50*b* to be positioned above the knees of the person using the apparatus. Foot stabilizer 16*b* is positioned as described above with respect to the embodiments of FIGS. 2 and 3 and 4–6. Also as in those embodiments, the crank handles 18 are supported for rotation about the common axis 22 which is essentially concentric with the knee stabilizer 14*b*.

Figure 10:
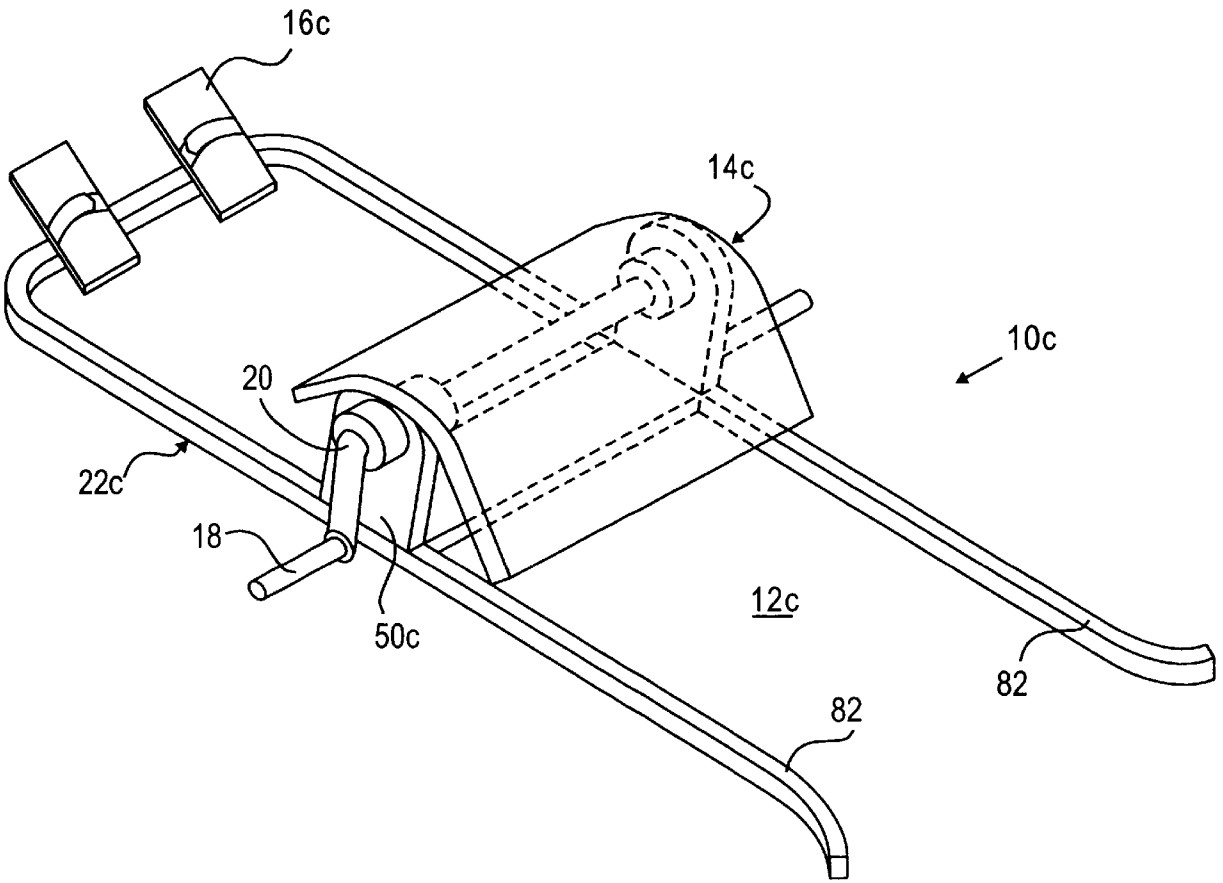
FIG. 10 is a perspective view illustrating a further embodiment of the invention.

In FIG. 10, another embodiment of the invention is illustrated in which a frame 22 of generally U-shaped configuration is intended to be placed on a floor or a mat. The frame has a pair of rearwardly extending stabilizing struts 82 spaced so that a person using the device may assume a seating position between the members 82 on a supporting surface 12*c* defined by the floor or mat on which the apparatus is supported. Also in this embodiment, the knee stabilizer 14*b* is in a nature of a pad folded over the top of the rear standard 50*c* on which the crank handles 18 are supported for the revolution about the axis 20. The foot stabilizer 16*c*, in this embodiment, is provided by foot pads 83 having bands 84 in which the user may insert his/her feet.

Figure 11:
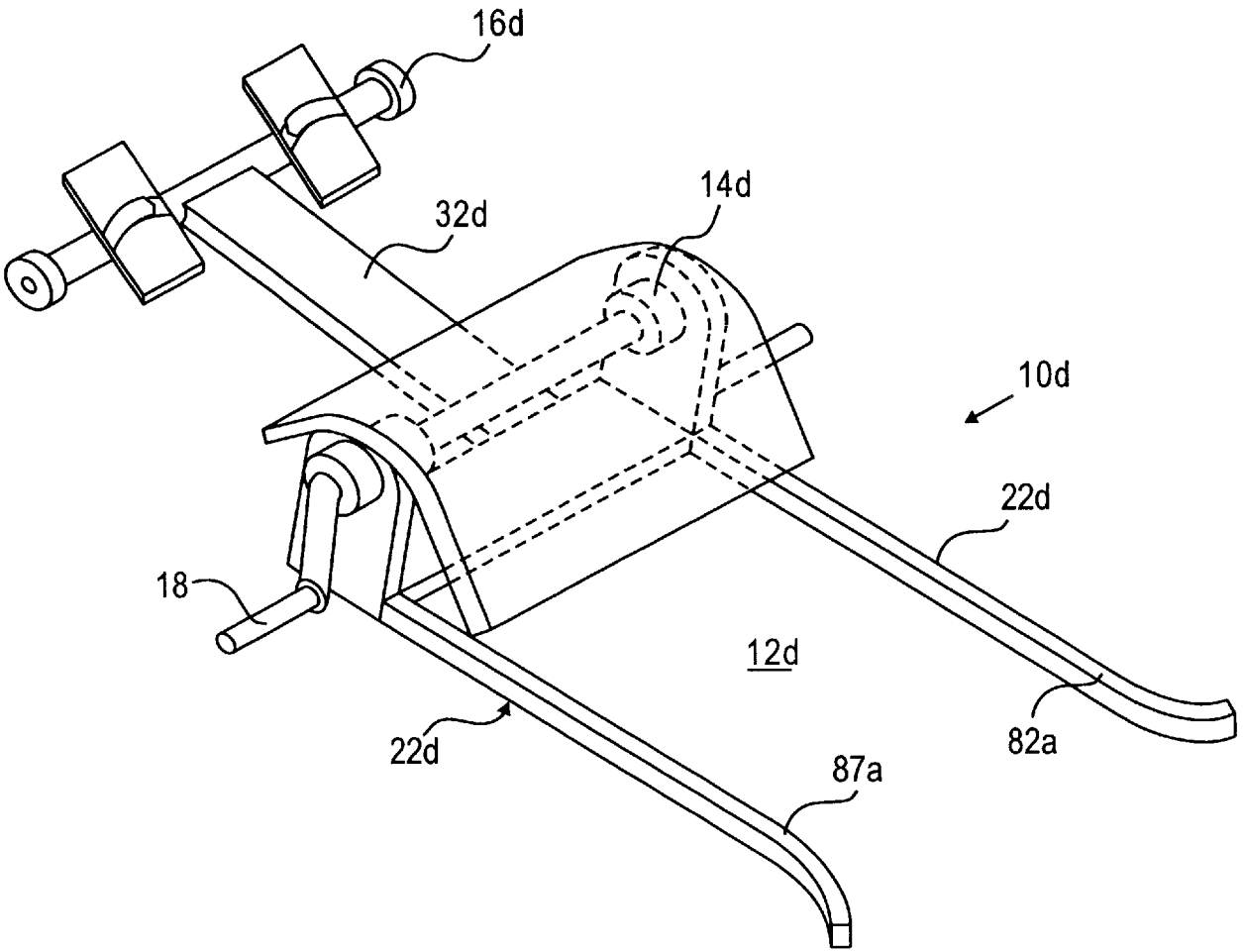
FIG. 11 is a variation of the embodiment illustrated in FIG. 10.

In FIG. 11, a modification of the embodiment shown in FIG. 10 is illustrated. In this embodiment, the front section of the frame 22*d* extends as a central beam 32*d* to support the foot stabilizer 16*d* of the type shown in FIG. 10.

Figure 12:
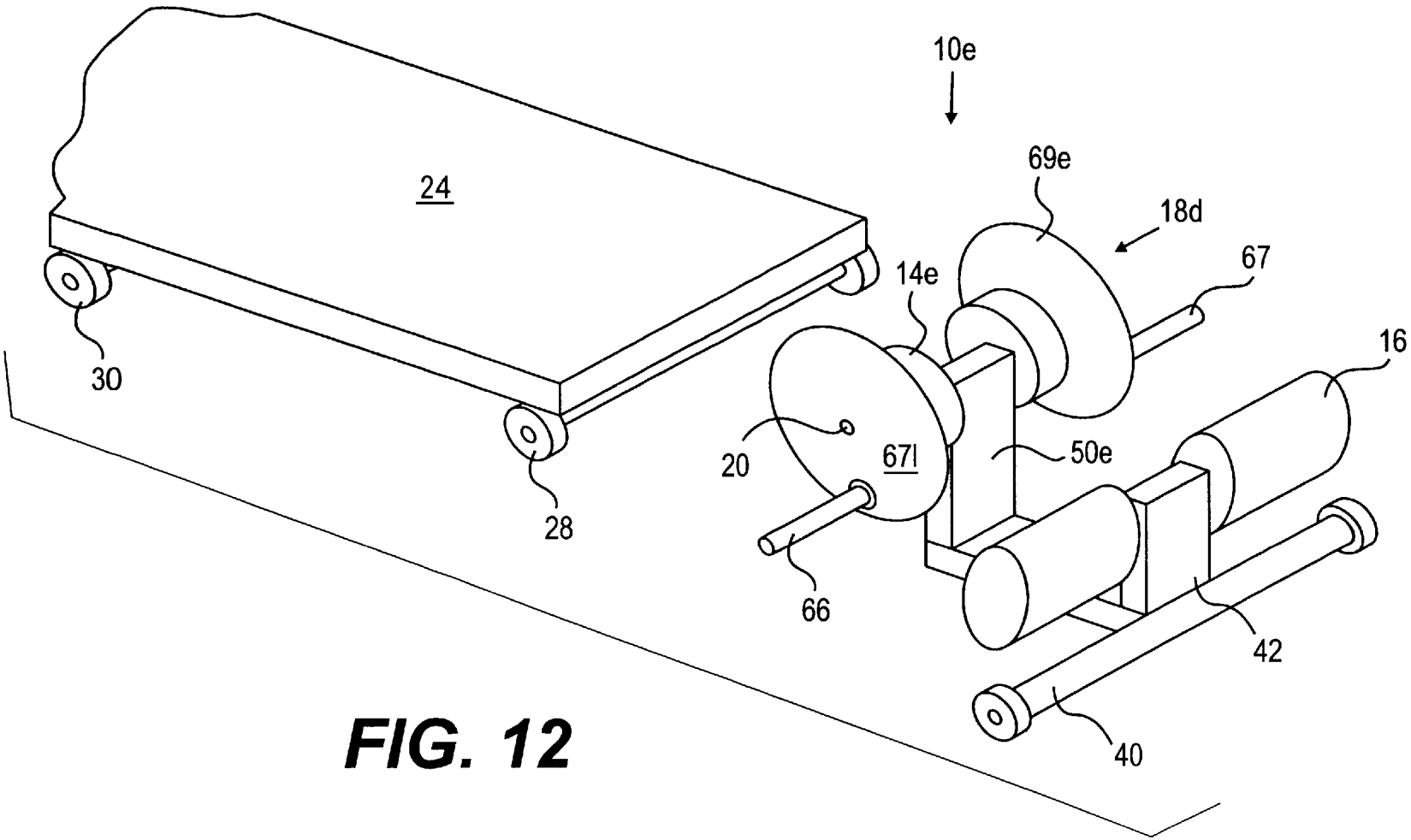
FIG. 12 is a further variation of the embodiment shown in FIG. 4.

In FIG. 12, a further alternative embodiment of the invention is shown in which the crank handles 18*d* are supported from enlarged discs 67*e* and 69*e*. The knee stabilizer 14*e* is again positioned within the discs 67*e* and 69*e*. An advantage of this embodiment is that the discs 67*e* and 69*e* may be restrained against rotation manually by the user exerting an outward force at his knees possibly with the use of pads to enhance the frictial drag without discomfort.

Figure 13:
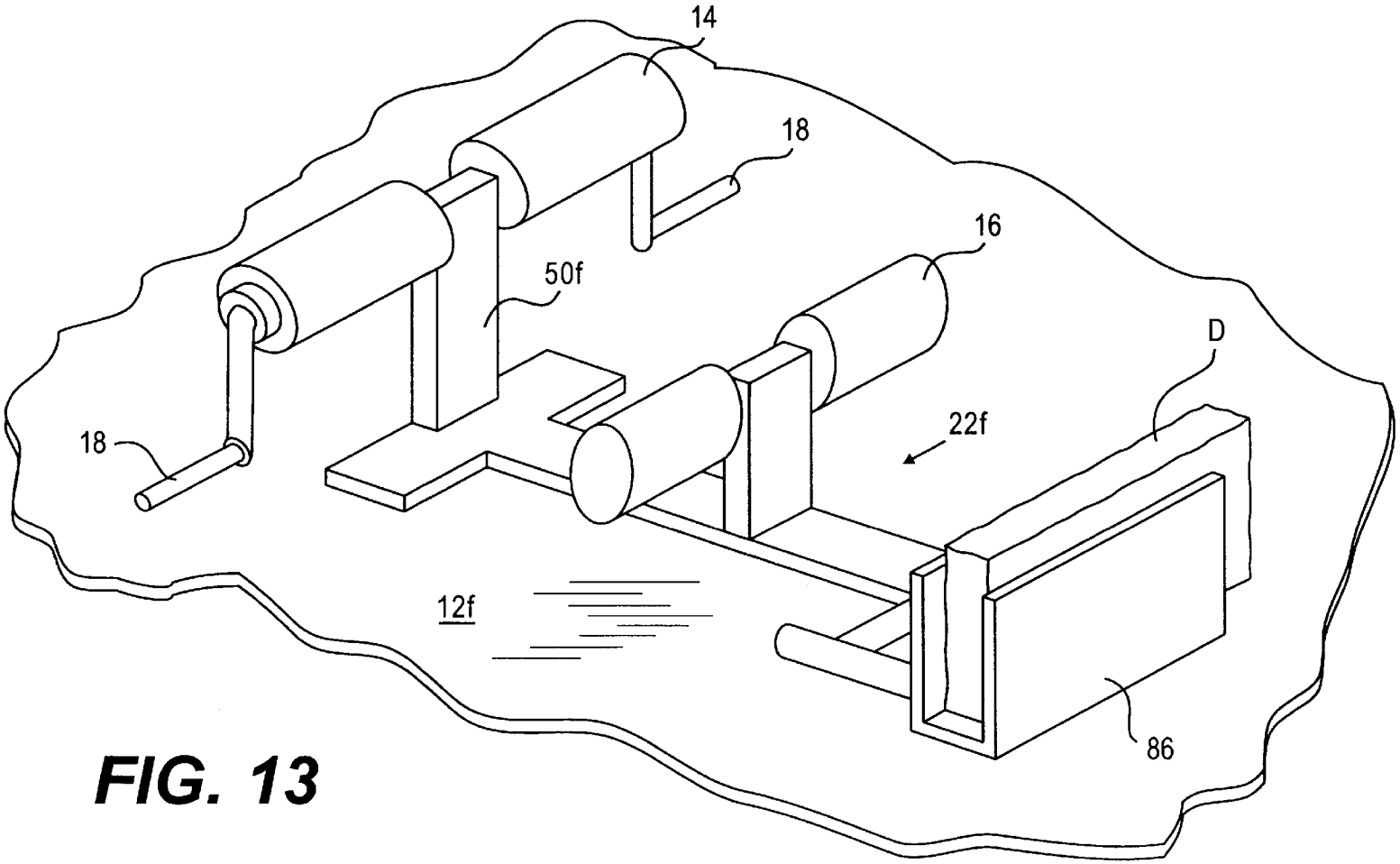
FIG. 13 is a perspective view illustrating a still further embodiment of the invention.

In FIG. 13, a further alternative embodiment is illustrated in which the device includes only a front frame section 22*f* having a channel shaped front member 86 to be engaged under the bottom of a door D, for example. In this embodiment, the user assumes a seating position on a floor surface 12*f* behind the illustrated apparatus. In all other respects, the operation is similar to the embodiments previously described.

Figure 14:
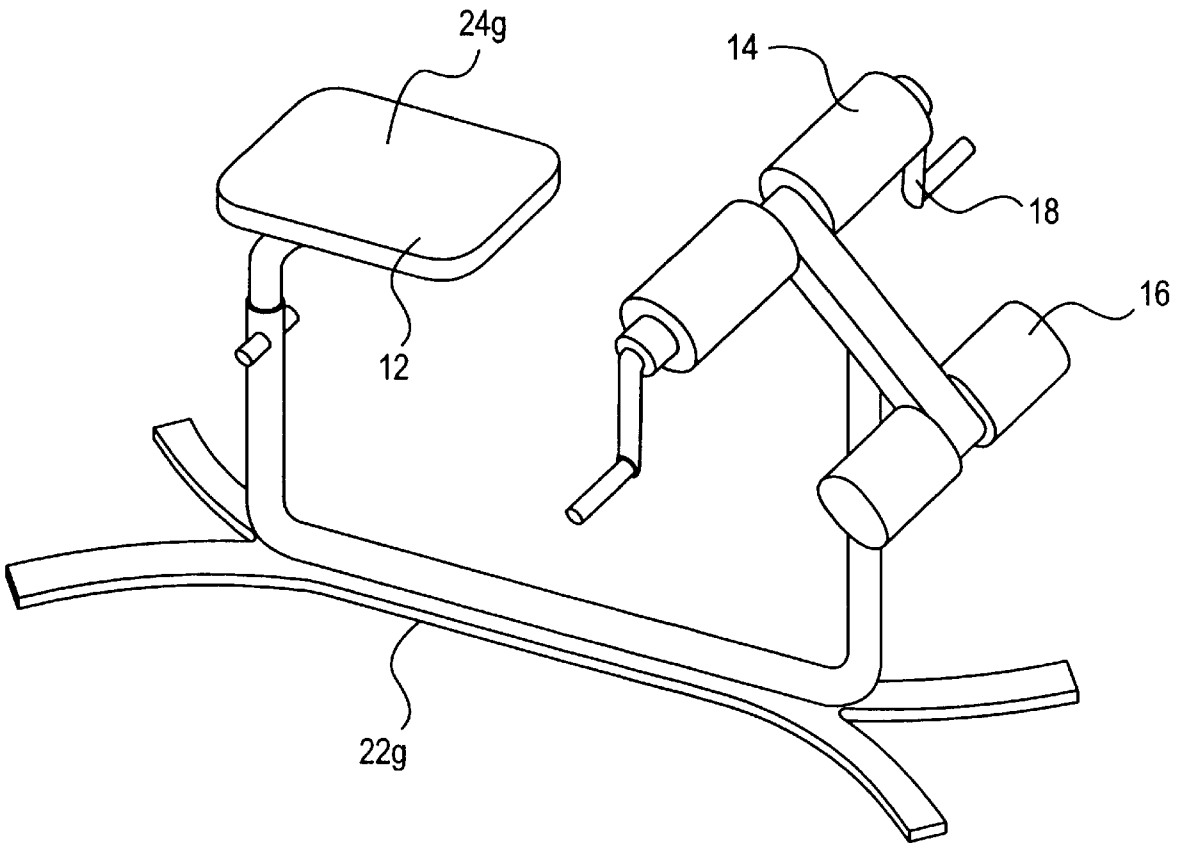
FIG. 14 is a perspective view of yet another alternative embodiment of the invention.

In FIG. 14, a still further embodiment of the invention is illustrated in which the seating surface 12 is elevated on a modified frame 22*g* as are the knee and foot stabilizers 14 and 16. Again, the crank handles are rotated on an axis essentially concentric with the knee stabilizers 14.

From the foregoing description, it will be apparent that advantages of the present invention include the provision of a device for exercising the abdominal and back muscles without over-stressing the muscles of the abdomen, back, hip, and neck; an abdominal exercise device by which resistance body movement can be easily adjusted so as to accommodate users of different strength, or to accommodate progressive resistance exercise for any individual user; an abdominal exercise apparatus which allows a user to perform repetitive exercising to obtain an aerobic workout promoting cardiovascular fitness; a guide to coordinate the movement of one's body while performing sit-up exercises; and an abdominal exercise device which is adaptable to a wide range of structural embodiments and corresponding range of manufacturing costs and availability to diverse user interests.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. An abdominal exercising apparatus comprising:

a frame located forwardly of a supporting surface on which a person may assume a seated position with knees in a first position elevated above the supporting surface and feet in a second position lower than the first position;

a leg stabilizer supported by the frame including a generally horizontal member supporting the knees from below to maintain the knees in the first position; and a pair of crank handles supported by the generally horizontal member for revolution about a crank axis located near the first position, the crank handles being located on opposite sides of the knees of the person to be movable through complete revolutions.

2. The abdominal exercising apparatus of claim 1, wherein said generally horizontal member comprises a knee stabilizer at the first position and said leg stabilizer further includes a foot stabilizer in the second position.

3. The abdominal exercising apparatus of claim 2, wherein the foot stabilizer is positioned above the feet of a person seated on the supporting surface.

4. The abdominal exercising apparatus of claim 1, wherein the leg stabilizer comprises a restraint positioned above the knees of a person seated on the supporting surface.

5. The abdominal exercising apparatus of claim 1, wherein the frame extends rearwardly of the leg stabilizer to provide a support for a pad defining the supporting surface.

6. The abdominal exercising apparatus of claim 1, wherein the frame extends rearwardly of the leg stabilizer on opposite sides of the supporting surface.

7. The abdominal exercising apparatus of claim 1, wherein the frame includes means located forwardly of the leg stabilizer for securing the frame against upward movement.

8. The abdominal exercising apparatus of claim 7, wherein the means for securing the frame against upward movement is engageable under a door.

9. The abdominal exercising apparatus of claim 2, wherein the frame includes a front standard for supporting the foot stabilizer and a rear standard for supporting the knee stabilizer.

10. The abdominal exercising apparatus of claim 9, wherein the foot stabilizer is adjustable vertically on the front standard.

11. The abdominal exercising apparatus of claim 9, wherein the knee stabilizer is adjustable vertically on the rear standard.

12. The abdominal exercising apparatus of claim 9, wherein the rear standard is inclined rearwardly.

13. The abdominal exercising apparatus of claim 9, wherein the front standard and the rear standard are mounted on a front frame section adjustable fore and aft of the supporting surface.

14. The abdominal exercising apparatus of claim 1, wherein the crank handles are each supported at one end of a crank arm supported for rotation on the crank axis.

15. The abdominal exercising apparatus of claim 14, including means for adjustably varying resistance to rotation of the crank arms about the crank axis.

16. The abdominal exercising apparatus of claim 15, wherein the means for adjustably varying resistance to rotation of the crank arms about the crank axis comprises an adjustable magnetic torque loading device.

17. The abdominal exercising apparatus of claim 15, wherein the means for adjustably varying resistance to rotation of the crank arms about the crank axis comprises an adjustable friction device.

18. The abdominal exercising apparatus of claim 14, wherein the crank arms are independently rotatable about the crank axis.

19. The abdominal exercising apparatus of claim 14, wherein the crank arms are connected to each other for rotation in unison about the crank axis.

20. The abdominal exercising apparatus of claim 19, wherein the crank arms lie in a common plane radiating from the crank axis.

21. An abdominal exercising apparatus comprising:

a frame located forwardly of a supporting surface on which a person may assume a seated or lying position;

a standard extending upwardly from said frame;

a pair of crank handles supported by an upper end of said standard, each of said crank handles being movable by a person, the crank handles being located on opposite sides of a support for the knees of the person to be movable through complete revolutions, the crank handles being accessible by the person's hands while lying or sitting on the supporting surface with the person's knees adjacent and between the crank handles.

22. The apparatus of claim 21, wherein said crank handles are movable independently of one another.

23. The apparatus of claim 21, wherein said crank handles are movable in unison.

24. The apparatus of claim 21, wherein said crank handles are rotatable about a common axis of rotation.

25. The apparatus of claim 24, wherein said crank handles are constrained to rotate together.

26. The apparatus of claim 21, wherein said supporting surface comprises a floor surface.

27. The apparatus of claim 21, wherein said supporting surface comprises a pad adjacent said frame.

28. The apparatus of claim 27, wherein said pad is supported on a portion of said frame.

29. The apparatus of claim 27, wherein said pad includes a back supporting surface.

30. The apparatus of claim 21, wherein a length of said standard is adjustable.

31. The apparatus of claim 21, wherein each crank handle is mounted on said standard via an adjustable torque loading device.

32. The apparatus of claim 21, wherein said frame includes means engageable under a door for preventing upward movement of said frame.

33. The apparatus of claim 21, wherein said standard is inclined toward said supporting surface.

34. An abdominal exercising apparatus comprising:

a frame located forwardly of a supporting surface on which a person may assume a seated or lying position with knees in a first position elevated above the supporting surface and feet in a second position lower than the first position, said frame including a support for the knees;

a pair of crank handles supported by the support for the knees, the crank handles being located on opposite sides of the knees of the person to be movable through complete revolutions.

35. The abdominal exercising apparatus of claim 34, wherein the frame extends rearwardly of the crank handles to provide a support for a pad defining the supporting surface.

36. The abdominal exercising apparatus of claim 34, wherein the frame includes means located forwardly of the crank handles for securing the frame against upward movement.

37. The abdominal exercising apparatus of claim 36, wherein the means for securing the frame against upward movement is engageable under a door.

38. The abdominal exercising apparatus of claim 34, wherein the frame includes a front standard for supporting a foot stabilizer and the crank handles, and a rear standard for supporting said knee support.

39. The abdominal exercising apparatus of claim 38, wherein the foot stabilizer is adjustable vertically on the front standard.

40. The abdominal exercising apparatus of claim 38, wherein the knee support and crank handles are adjustable vertically on the rear standard.

41. The abdominal exercising apparatus of claim 40, wherein the rear standard is inclined rearwardly.

42. The abdominal exercising apparatus of claim 34, including means for adjustably varying resistance to movement of the crank arms.

43. The abdominal exercising apparatus of claim 42, wherein the means for adjustably varying resistance to movement of the crank arms comprises an adjustable magnetic torque loading device.

44. The abdominal exercising apparatus of claim 42, wherein the means for adjustably varying resistance to rotation of the crank arms comprises an adjustable friction device.

45. The abdominal exercising apparatus of claim 34, wherein the crank arms are independently rotatable about a crank axis.

46. The abdominal exercising apparatus of claim 34, wherein the crank arms are connected to each other for rotation in unison about a crank axis.

47. An abdominal exercising apparatus comprising:

a frame having a portion located forwardly of a supporting surface on which a person may assume a seated or lying position;

a pair of crank handles supported above an elevation of said supporting surface for movement with respect to said frame, said crank handles being supported on a knee support adapted to support the knees from below, the crank handles being located on opposite sides of the knees of the person and being accessible by the person's hands while the person is lying or sitting on the supporting surface with the person's knees adjacent and between the crank handles.

48. The apparatus of claim 47, wherein said crank handles are movable independently of one another.

49. The apparatus of claim 47, wherein said crank handles are movable in unison.

50. The apparatus of claim 47, wherein said crank handles are rotatable about a common axis of rotation.

51. The apparatus of claim 50, wherein said crank handles are constrained to rotate together.

52. The apparatus of claim 47, wherein the supporting surface comprises a pad supported on a further portion of said frame.

53. The apparatus of claim 47, wherein said crank handles are mounted on said frame via an adjustable torque loading device.

54. The apparatus of claim 47, wherein said frame includes means engageable under a door for preventing upward movement of said frame.

* * * * *